US006781314B2

(12) United States Patent
Shon et al.

(10) Patent No.: US 6,781,314 B2
(45) Date of Patent: Aug. 24, 2004

(54) MAGNETRON

(75) Inventors: Jong-Chull Shon, Suwon (KR); Boris V. Rayskiy, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/300,597

(22) Filed: Nov. 21, 2002

(65) Prior Publication Data

US 2004/0012335 A1 Jan. 22, 2004

(30) Foreign Application Priority Data

Jul. 18, 2002 (KR) ..... 2002-41968

(51) Int. Cl.[7] ..... H01J 25/50

(52) U.S. Cl. ..... 315/39.51; 315/39.57; 219/748

(58) Field of Search ..... 315/39.51, 39.55, 315/39.57, 39.61, 39.59, 39.69, 39.71; 219/746, 748; 343/900, 700 R; H01J 25/50

(56) References Cited

U.S. PATENT DOCUMENTS 4,300,072 A * 11/1981 Tashiro ..... 315/39.51
5,090,613 A * 2/1992 Lee ..... 228/254
5,350,905 A 9/1994 Choi ..... 219/761
2002/0043937 A1 4/2002 Ogura et al. ..... 315/39.51

FOREIGN PATENT DOCUMENTS

JP 54-158160 A * 12/1979 ..... H01J/23/14
JP 11-307000 * 11/1999 ..... H01J/23/40
KR 2000-15861 8/2000 ..... H01Q/1/18

OTHER PUBLICATIONS

Patent Abstracts of Japan, Pub. No. 05190104, Jul. 30, 1993.
Patent Abstracts of Japan, Pub. No. 57074942, May 11, 1982.
Patent Abstracts of Japan, Pub. No. 2000264149, Sep. 26, 2000.
Patent Abstracts of Japan, Pub. No. 06036684, Feb. 10, 1994.

* cited by examiner

*Primary Examiner*—Don Wong
*Assistant Examiner*—Trinh Vo Dinh
(74) *Attorney, Agent, or Firm*—Staas & Halsey LLP

(57) ABSTRACT

A magnetron includes a filament to irradiate thermoelectrons, a plurality of anodic vanes arranged around the filament in radial directions, and an antenna connected to at least one of the anodic vanes. The vane connected to the antenna is provided with an antenna holding part. The antenna holding part outwardly extends from an upper edge of the vane by a predetermined length to connect the antenna to the vane.

7 Claims, 3 Drawing Sheets

MAGNETRON

CROSS-REFERENCE TO RELATED APPLICATION

This application claims the benefit of Korean Application No. 2002-41968, filed Jul. 18, 2002, in the Korean Intellectual Property Office, the disclosure of which is incorporated herein by reference.

BACKGROUND OF THE INVENTION

1 Field of the Invention

The present invention relates generally to magnetrons, and more particularly, to an antenna connecting structure of a magnetron, which allows vanes to have the same frequency characteristics when an antenna combines with at least one of the vanes.

2. Description of the Related Art

As is well known to those skilled in the art, an antenna of a microwave oven's magnetron serves to radiate high-frequency electromagnetic waves oscillated from an anodic part to a cooking cavity.

FIG. 1 is a sectional view showing a structure to connect an antenna to a vane in a conventional magnetron. As shown in FIG. 1, the magnetron includes an antenna 1 having a thin and long rod-shaped body. The antenna 1 upwardly extends to be connected at its first end to a radiating tube. A second end of the antenna 1 is connected to one of vanes 3 which are radially arranged along an inner surface of a hollow anodic cylinder 2. In order to connect the antenna 1 to the vane 3, an antenna seating recess 4 is formed on an upper edge of the vane 3 at a position corresponding to the antenna 1 so that the antenna 1 is seated in the antenna seating recess 4.

When electrons radiate from a filament 5 to an inside edge of the vane 3, a Lorentz force is applied to the electrons by an electric field and a magnetic field which cross at a right angle, so that the electrons actively rotate in an actuation space 6. Inside edges of the vanes 3 are affected by a high-frequency electric field, so that there occurs a high-frequency oscillation of cavity resonators. When a high-frequency voltage is induced by the high-frequency oscillation, microwaves are generated in the high-frequency electric field and are radiated through the antenna 1 to an outside, thus finally reaching a cooking cavity.

Since the high-frequency oscillation is determined by a resonance frequency of each of the cavity resonators, the resonance frequency is determined by a size of each cavity defined by two neighboring vanes 3 and an inner surface of the anodic cylinder 2.

The vanes 3 are radially arranged on the inner surface of the anodic cylinder 2 in such a way as to face a central axis of the anodic cylinder 2. The cavity resonators are formed by the cavity defined by a pair of the vanes 3 and the inner surface of the anodic cylinder 2. Inductance of the cavity resonator is determined by lengths of two neighboring vanes 3. Capacitance of the cavity resonator is determined by surface areas of facing surfaces of the neighboring vanes 3.

However, when the antenna 1 is connected to the antenna seating recess 4 of the at least one of the vanes 3, there is a difference in area between the vane 3 connected to the antenna 1, and two vanes 3 adjacent to the vane 3 that are connected to the antenna 1. Thus, the conventional magnetron has a problem in that there is a difference in capacitance between the vane 3 connected to the antenna 1 and the two vanes 3 adjacent to the vane 3 connected to the antenna 1. Therefore, different resonance frequencies are generated, thus degrading an operational efficiency of the magnetron.

SUMMARY OF THE INVENTION

Accordingly, it is an aspect of the present invention to provide a magnetron, which accomplishes a symmetrical structure of resonators, thus allowing the resonators to have the same frequency characteristics.

Additional aspects and advantages of the invention will be set forth in part in the description which follows and, in part, will be obvious from the description, or may be learned by practice of the invention.

The foregoing and other aspects of the present invention are achieved by providing a magnetron including a filament to irradiate thermoelectrons, a plurality of anodic vanes arranged around the filament in radial directions, and an antenna connected to at least one of the anodic vanes. A vane connected to the antenna is provided with an antenna holding part, and the antenna holding part outwardly extends from an edge of the vane by a predetermined length to connect the antenna to the vane.

BRIEF DESCRIPTION OF THE DRAWINGS

The above and other aspects, features and advantages of the present invention will become apparent and more appreciated from the following description of the preferred embodiment, taken in conjunction with the accompanying drawings of which.

DETAILED DESCRIPTION OF THE PREFERRED EMBODIMENT

Figure 1:
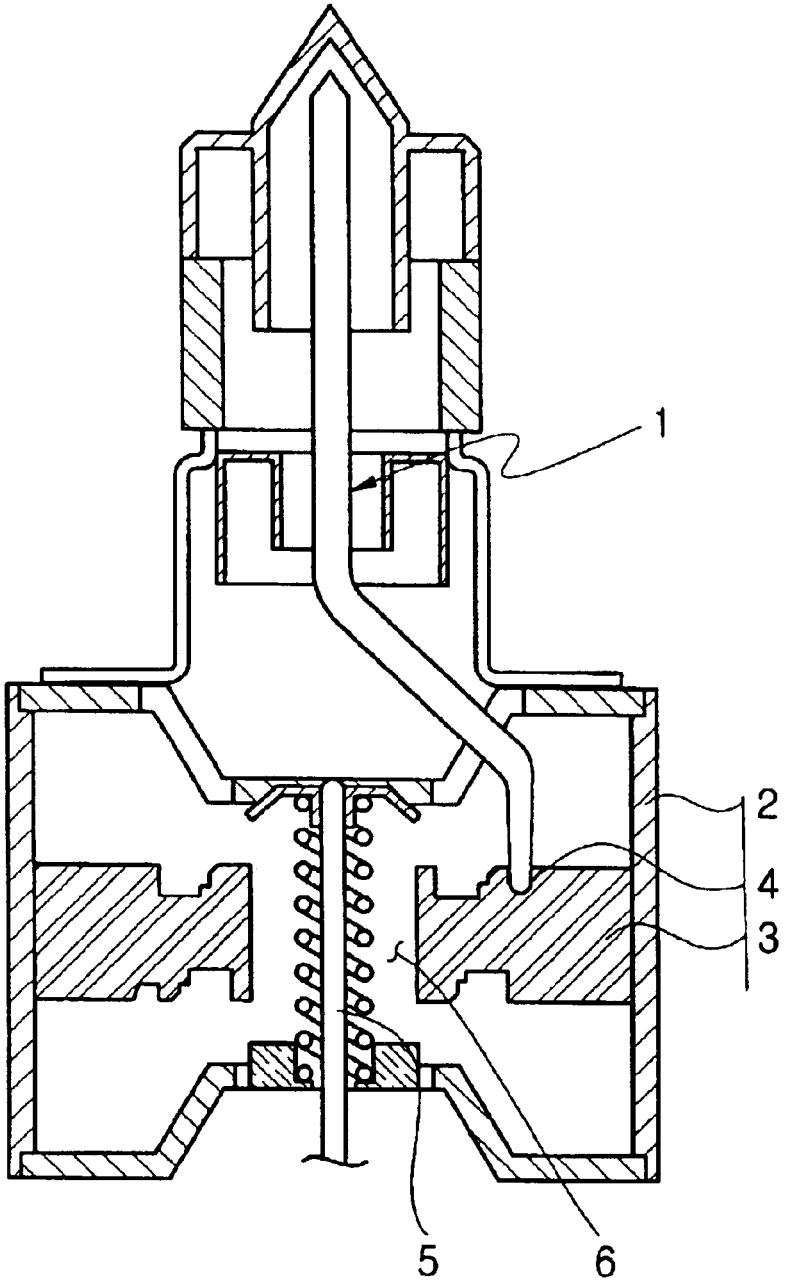
FIG. 1 (PRIOR ART)
FIG. 1 is a sectional view showing a structure to connect an antenna to a vane in a conventional magnetron.

Reference will now be made in detail to the present preferred embodiment of the present invention, examples of which are illustrated in the accompanying drawings, wherein like reference numerals refer to like elements throughout.

Figure 2:
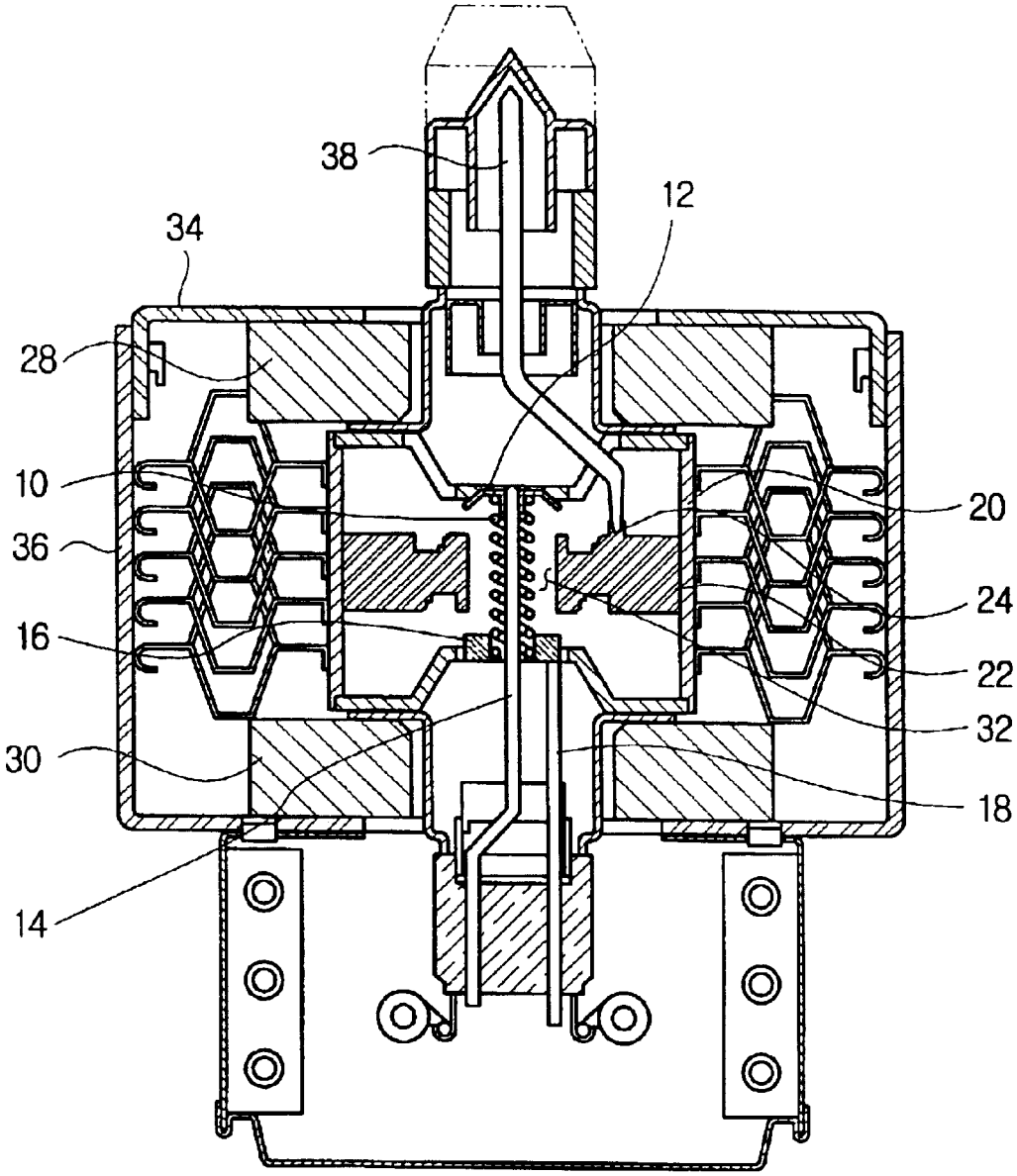
FIG. 2 is a sectional view showing an interior structure of a magnetron, according to an embodiment of the present invention.

FIG. 2 is a sectional view showing an interior structure of a magnetron, according to an embodiment of the present invention. Referring to FIG. 2, a cathodic part of the magnetron includes a filament 10 which is positioned along a central axis of the magnetron. The filament 10 is supported by a center lead 14 and a side lead 18. The center lead 14 is connected to a first end of the filament 10 through an upper shield 12, and the side lead 18 is connected to a second end of the filament 10 through a lower shield 16.

An anodic part of the magnetron includes an anodic cylinder 20 and a plurality of vanes 22. The vanes 22 are projected inward from an inner surface of the anodic cylinder 20 in radial directions in such a way as to be spaced at their inside edges apart from the filament 10 by predetermined intervals.

Annular permanent magnets 28 and 30 are installed above and under the anodic cylinder 20. Magnetic flux propagates from an upper permanent magnet 28 through an actuation space 32 defined between the filament 10 and inside edges of the vanes 22 to a lower permanent magnet 30 so as to form a static magnetic field along an axial direction of the anodic cylinder 20. Magnetic members, including the upper permanent magnet 28, an upper yoke 34, a lower yoke 36, and the lower permanent magnet 30, constitute a magnetic circuit.

When electrons radiate from the filament 10, which has a negative charge with respect to the anodic vanes 22 of a ground charge, to the inside edges of the anodic vanes 22, a Lorentz force is applied to the electrons by an electric field and a magnetic field which cross at a right angle, so that the electrons actively rotate in the actuation space 32. Here, the inside edges of the anodic vanes 22 are affected by a high-frequency electric field, so there occurs a high-frequency oscillation of cavity resonators inside an inner surface of the anodic cylinder 20. When a high-frequency voltage is induced by the high-frequency oscillation, microwaves are generated in the high-frequency electric field and are radiated through an antenna 38 to an outside, thus finally reaching a cooking cavity.

Figure 3:
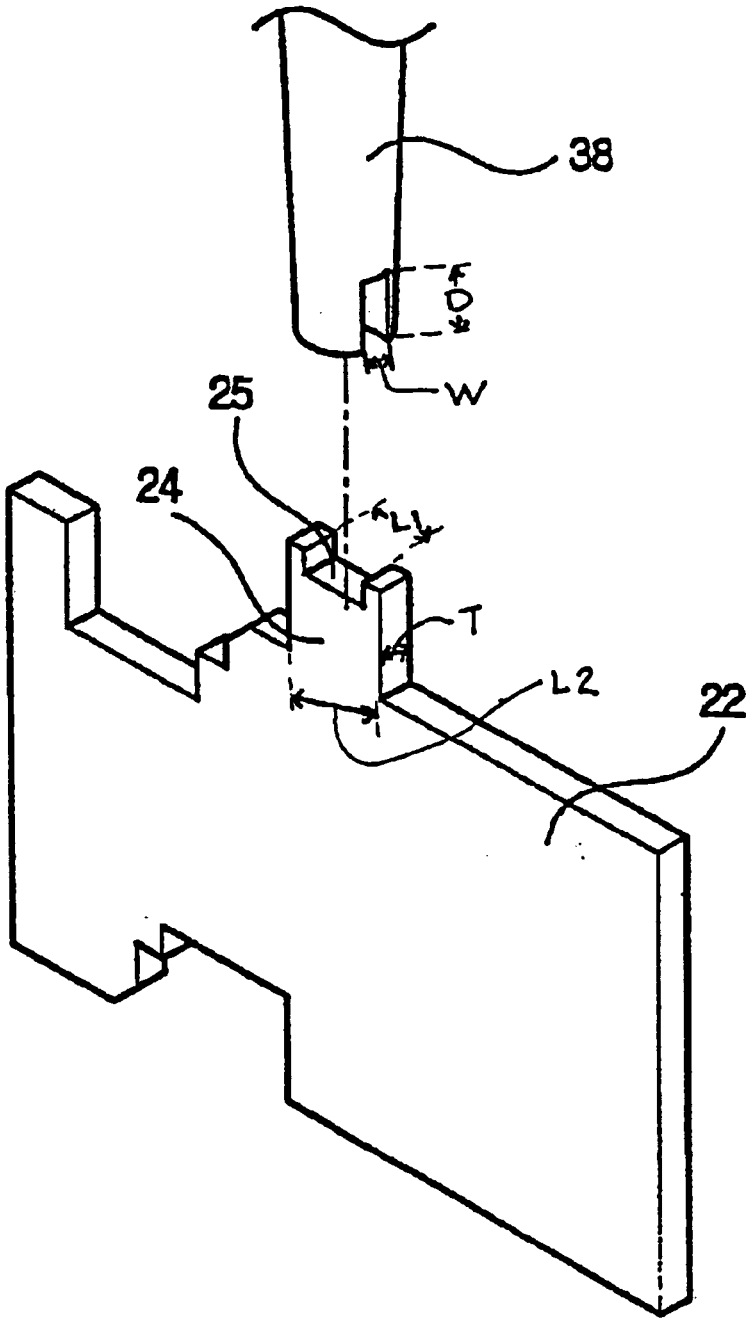
FIG. 3 is an exploded perspective view showing a structure to connect an antenna to a vane in the magnetron of FIG. 2.

FIG. 3 is an exploded perspective view showing a structure to connect the antenna 38 to the vane 22 in the magnetron shown in FIG. 2. Referring to FIG. 3, the anodic vane 22 connected to the antenna 38 is provided with an antenna holding part 24. The antenna holding part 24 outwardly extends from an upper edge of the vane 22 by a predetermined length to connect the antenna 38 to the vane 22. The antenna holding part 24 is provided at its end with an antenna seating recess 25 in which the antenna 38 is seated. Further, the antenna 38 is provided at its lower end with a longitudinal slit having a width W corresponding to a thickness T of the antenna holding part 24.

An antenna seating recess 25 is also provided in the magnetron and has a length L1 corresponding to an outer diameter of the antenna 38. A depth D of the longitudinal slit of the antenna 38 is smaller than a length L2 of the antenna holding part 24.

The antenna 38 is not directly connected to the main body of the vane 22 where the other vanes 22 face each other, but is connected to the antenna holding part 24 which is projected from on an upper edge of the main body of the vane 22. Thus, symmetrical structures among the vanes 22 are achieved so that surface areas of facing surfaces of the vanes 22 are equal to each other. Therefore, the cavity resonators of the vanes 22 that face each other and the inner surface of the anodic cylinder 20 have the same capacitance, thus generating the same resonance frequency.

As described above, the present invention provides a magnetron, which is designed such that an antenna is connected to an antenna holding part outwardly extending from an upper edge of a vane, so that symmetrical structures among the vanes are achieved to prevent harmonic waves from being generated due to a difference in shapes of the vanes, thus increasing an operational efficiency of the magnetron.

Although a preferred embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A magnetron, comprising:

a filament to irradiate thermoelectrons;

a plurality of anodic vanes arranged around said filament in radial directions; and an antenna connected to at least one of said anodic vanes, wherein the at least one anodic vane connected to the antenna is provided with an antenna holding part, said antenna holding part outwardly extending from an upper edge of the at least one anodic vane by a predetermined length to connect the antenna to the at least one anodic vane.

2. The magnetron according to claim 1, wherein said antenna holding part is provided at an end thereof with an antenna seating recess having a length corresponding to an outer diameter of the antenna, and said antenna is provided with a longitudinal slit having a width corresponding to a thickness of the antenna holding part.

3. The magnetron according to claim 2, wherein a depth of the longitudinal slit of the antenna is smaller than a length of the antenna holding part.

4. The magnetron according to claim 1, wherein surface areas of the anodic vanes, except for a portion of the vane having the antenna holding part, are equal to each other.

5. A magnetron, comprising:

an antenna provided inside the magnetron; and a plurality of anodic vanes, wherein at least one of the plurality of anodic vanes is connected to the antenna and comprises an antenna holding part to outwardly extend from an upper edge of the at least one anodic vane by a predetermined length to connect the antenna to the at least one anodic vane.

6. The magnetron according to claim 5, wherein surface areas of facing surfaces of the vanes are equal to each other, thereby generating similar resonance frequencies between respective neighboring vanes and an inner surface of an anodic cylinder of the magnetron.

7. The magnetron according to claim 5, wherein the antenna is connected to the antenna holding part at the upper edge of the at least one anodic vane so that symmetrical structures exist among the plurality of anodic vanes, thereby preventing harmonic waves from being generating in the magnetron.

* * * * *